US007299854B2

(12) United States Patent
Kamm et al.

(10) Patent No.: US 7,299,854 B2
(45) **Date of Patent: *Nov. 27, 2007**

(54) SEMI-SOLID MOLDING METHOD

(75) Inventors: Richard J. Kamm, Vandalia, OH (US); John L. Jorstad, Richmond, VA (US)

(73) Assignee: T.H.T. Presses, Inc., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/373,565

(22) Filed: Mar. 10, 2006

(65) Prior Publication Data

US 2006/0151138 A1 Jul. 13, 2006

Related U.S. Application Data

(60) Division of application No. 10/972,620, filed on Oct. 25, 2004, now abandoned, which is a continuation-in-part of application No. 10/700,004, filed on Nov. 3, 2003, now Pat. No. 6,808,004, which is a continuation of application No. 10/066,527, filed on Jan. 31, 2002, now abandoned.

(51) Int. Cl.
*B22D 17/12* (2006.01)
*B22D 23/00* (2006.01)
*B22D 25/00* (2006.01)

(52) U.S. Cl. ..... 164/113; 164/312; 164/900

(58) Field of Classification Search ..... 164/113, 164/312, 900

See application file for complete search history.

(56) References Cited

U.S. PATENT DOCUMENTS 3,954,455 A 5/1976 Flemings et al.

(Continued)

FOREIGN PATENT DOCUMENTS

DE 37 24 561 2/1989

(Continued)

OTHER PUBLICATIONS

John L. Jorstad, Science and Technology of Semi-Solid Metal Processing, Chapter 4, "Processing of SSM: Practical Considerations".

(Continued)

*Primary Examiner*—Kuang Lin
(74) *Attorney, Agent, or Firm*—Jacox, Meckstroth & Jenkins

(57) ABSTRACT

A metal alloy is heated to a molten state, and a grain refiner may be added. The molten alloy is poured into a shallow chamber of a shot sleeve of a vertical die cast press and on top of a shot piston. The shot sleeve is transferred to an injection station while the molten alloy cools to a semi-solid slurry with a globular, generally non-dendritic micro structure. An inner portion of the shallow slurry is injected upwardly by the piston through a gate opening into a die cavity while an outer more solid portion of the slurry is entrapped in an annular recess. After the slurry solidifies, the shot piston retracts, and the shot sleeve is transferred to a position where the residual biscuit is removed. The shot piston may have internal grooves to provide a large heat transfer area for cooling water to absorb heat from the molten alloy.

6 Claims, 4 Drawing Sheets

U.S. PATENT DOCUMENTS

| | | | | |
|---|---|---|---|---|
| 4,434,837 | A | 3/1984 | Winter et al. | |
| 5,161,601 | A | 11/1992 | Abis et al. | |
| 5,579,825 | A | 12/1996 | Shibata et al. | |
| 5,660,223 | A | 8/1997 | Thieman et al. | |
| 5,701,942 | A | 12/1997 | Adachi et al. | |
| 5,730,201 | A * | 3/1998 | Rollin et al. | 164/113 |
| 5,979,534 | A | 11/1999 | Shibata et al. | |
| 6,068,043 | A | 5/2000 | Clark | |
| 6,165,411 | A | 12/2000 | Adachi et al. | |
| 6,478,075 | B1 * | 11/2002 | Shibata et al. | 164/113 |
| 6,742,567 | B2 * | 6/2004 | Winterbottom et al. | 164/113 |
| 6,808,004 | B2 * | 10/2004 | Kamm et al. | 164/113 |
| 6,901,991 | B2 * | 6/2005 | Kamm et al. | 164/113 |
| 2004/0055726 | A1 | 3/2004 | Hong et al. | |

FOREIGN PATENT DOCUMENTS

| | | | |
|---|---|---|---|
| DE | 4232742 | A1 | 3/1994 |
| EP | 0 554 808 | A1 | 8/1993 |
| JP | 1-95858 | | 4/1989 |
| JP | 9-103861 | | 4/1997 |
| JP | 10-58108 | | 3/1998 |
| WO | WO-99/00203 | A1 | 1/1999 |

OTHER PUBLICATIONS

Proceedings 5th International Conference on Semi-Solid Processing of Alloys and Composites—Jun. 1998.

* cited by examiner

SEMI-SOLID MOLDING METHOD

RELATED APPLICATIONS

This application is a division of application Ser. No. 10/972,620, filed Oct. 25, 2004 now abandonded, which is a continuation-in-part of application Ser. No. 10/700,004, filed Nov. 3, 2003, U.S. Pat. No. 6,808,004, which is a continuation of application Ser. No. 10/066,527, filed Jan. 31, 2002, abandoned.

BACKGROUND OF THE INVENTION

The present invention relates to semi-solid molding (SSM) of metal alloys and the equipment and methods used for SSM, and which are disclosed in many U.S. and foreign patents, for example, in U.S. Pat. Nos. 3,954,455, 4,434,837, 5,161,601 and 6,165,411. SSM is also discussed in technical publications, for example, in a book entitled *Science and Technology of Semi-Solid Metal Processing*, published by North American Die Casting Association in October, 2001. Chapter 4 of this publication was authored by a co-inventor of the present invention. In conventional SSM processes, it is necessary to use either a specially treated, pre-cast billet of appropriate microstructure or a slurry especially prepared from molten alloy in equipment external to a die casting press. The cost premiums associated with either the pre cast specially treated billet that must be sawed to length before using, or the slurry especially prepared in equipment external to the die casting press, have severely limited the commercial applications of the SSM processes. Also, the pre-cast billet is available from a relatively few sources, is currently made only from primary alloys, and process offal cannot be reused unless reprocessed back into a billet.

Still, SSM provides some important and highly desirable characteristics. Unlike conventional die castings, die cast parts which are produced using SSM processes can be produced substantially free of porosity, they are able to undergo high temperature thermal processing without blistering, they can be made from premium alloys, and they provide reliable high levels of strength and ductility when made using appropriate alloys and heat treatments. Because of the thixotropic nature of semi-solid slurry and the non-turbulent way that relatively viscous thixotropic slurries flow in die casting dies, the SSM process is capable of producing cast parts having thin sections, great detail and complexity and close dimensional tolerances, without the entrapped porosity and oxides which are commonplace in conventional die casting processes.

SUMMARY OF THE INVENTION

The present invention is directed to a new SSM process or method which significantly reduces the costs of producing parts by the SSM process. The method of the invention is ideally suited for producing parts having thin sections, fine detail and complexity and close dimensional tolerances, and which are substantially free of porosity and oxides, can be processed at elevated temperatures without blistering and which can provide high and reliable levels of strength and ductility. The method of the invention avoids any need to produce a specially treated, pre-cast billet that must be sawed to length before using or a slurry especially prepared from molten alloy in equipment external to the die casting press. The method of the invention is also applicable to a wide variety of alloys, for example, standard A356 alloy and alloys of the Al—Si, Al—Cu, Al—Mg and Al—Zn families, all of which can be acquired in the form of and at prices normal to conventional foundry ingot, including both primary and secondary origin.

In accordance with one embodiment of the present invention, an ingot of commercially available solid metal or metal alloy, such as aluminum foundry alloy ingot, is heated to the molten state. If not permanently grain refined, such as by employing a foundry alloy called SiBloy produced by Elkem Aluminum, AS, an α aluminum grain refining material such as 5:1::Ti:B master alloy produced by numerous suppliers, or a product called TiBloy produced by Metallurg, is added to the molten alloy in appropriate quantities to accomplish fine grains in the solidified alloy product. The grain refined molten alloy is poured directly into a large diameter shot sleeve or chamber of a vertical die casting machine or press. The shot chamber receives a vertically movable shot piston which forms the bottom of the shot chamber, and the diameter of the shot chamber is greater than its depth or axial length. In a preferred embodiment of the present invention, the shallow shot chamber is greater than its depth by a ratio of 2:1 or more. The shot chamber is then indexed from the initial filling position to a slurry injection position under a die. The molten alloy is permitted to cool within the shot chamber to a predetermined temperature range in which it forms a semi-solid slurry having 40 to 60 percent solid, the solid fraction having a globular, generally non-dendritic microstructure. The portion of the slurry immediately adjacent to the wall of the shot chamber or shot sleeve and the shot piston become significantly colder and more solid.

When the semi-solid slurry within the central portion of a first shot chamber, now in the slurry injection position under the die, has cooled to the predetermined temperature range in which it has 40 to 60 percent solid, the shot piston is moved upwardly by a mechanical actuator or a hydraulic shot cylinder to transfer or inject the semi-solid slurry within the central portion of the shot chamber through one or more gate or sprue openings and into one or more cavities in the die above the shot chamber. The more solid portion of the slurry adjacent the shot sleeve is prevented from entering the die cavity or cavities, either by appropriately distancing the gate or sprue openings from the shot sleeve walls or by entrapping the more solid portion within an annular recess in the gate plate through which the gates or sprue openings communicate with the die cavity or cavities. As a result, the more solid portion of the slurry remains in the residual solidified biscuit. After the semi-solid slurry solidifies in the die cavity or cavities, the shot piston retracts to retract the biscuit intact with gates or sprues. The shot chamber is then transferred or indexed back to its initial filling position where the biscuit with the gates is removed laterally from the shot chamber and piston, and the shot chamber is then ready to repeat the cycle. After the die is opened, the part(s) is ejected and then indexed to a position where it is removed, and the die is ready to repeat the cycle.

During the slurry forming, slurry injection and slurry solidification steps described above relative to the first shot chamber while in its shot position, a second shot chamber in the original filling position has similarly been filled with grain refined molten alloy. When the first shot chamber and its piston are transferred or indexed back to the initial filling position for biscuit removal, the second shot chamber and molten alloy are indexed to the metal transfer or slurry injection position under the die, and the process of slurry formation, slurry injection and slurry solidification is accomplished just as with the first shot chamber. The process is repeated over and over again. In a modification, the shot piston is provided with internal interconnected spaced grooves through which cooling fluid or water is circulated to provide a large heat transfer area for absorbing heat from the molten metal or alloy within the shot chamber.

Other features and advantages of the invention will be apparent from the following description, the accompanying drawings and the appended claims.

DESCRIPTION OF THE PREFERRED EMBODIMENTS

Figure 1:
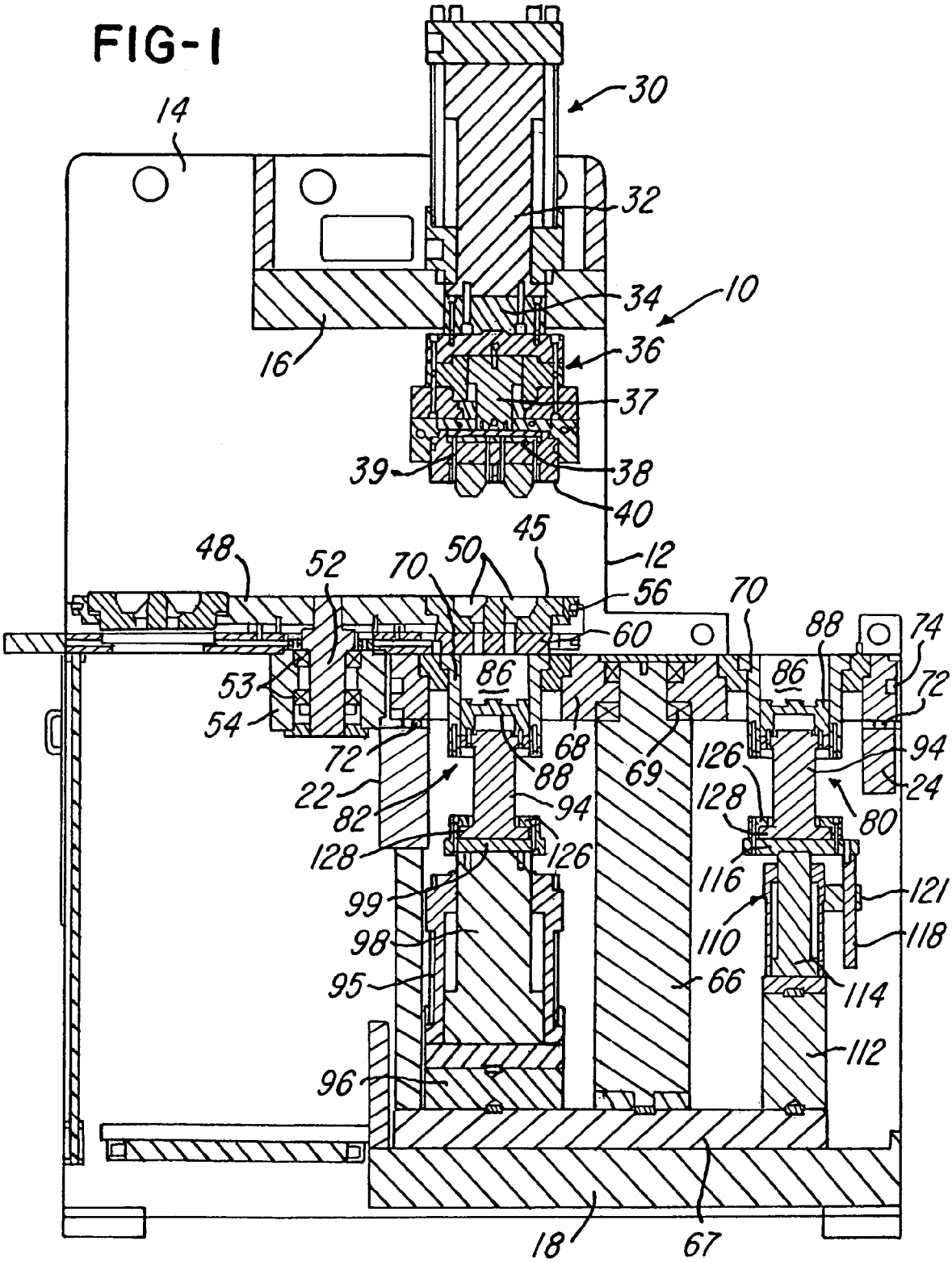
FIG. 1 is a vertical section through a vertical die casting press which is used to perform the method of the invention and with the die set shown in its open position.

Referring to FIG. 1, a vertical die cast machine or press 10 is constructed similar to the press disclosed in U.S. Pat. No. 5,660,223 which issued to the assignee of the present invention and the disclosure of which is incorporated by reference. The press 10 includes a frame 12 formed by a pair of parallel spaced vertical side walls or plates 14 rigidly connected by top plate 16 a base or bottom plate 18 and a set of intermediate cross plates or bars 22 and 24 all rigidly secured to the side panels 14. The top cross plate 16 supports an upper double acting hydraulic clamping cylinder 30 having a piston rod 32 projecting downwardly on a vertical center axis of the press. The piston rod 32 carries an adapter plate 34 which supports a hydraulic ejector cylinder 36 having a piston 37 projecting downwardly to support a plate 38 which carries a set of ejector pins 39.

Figure 2:
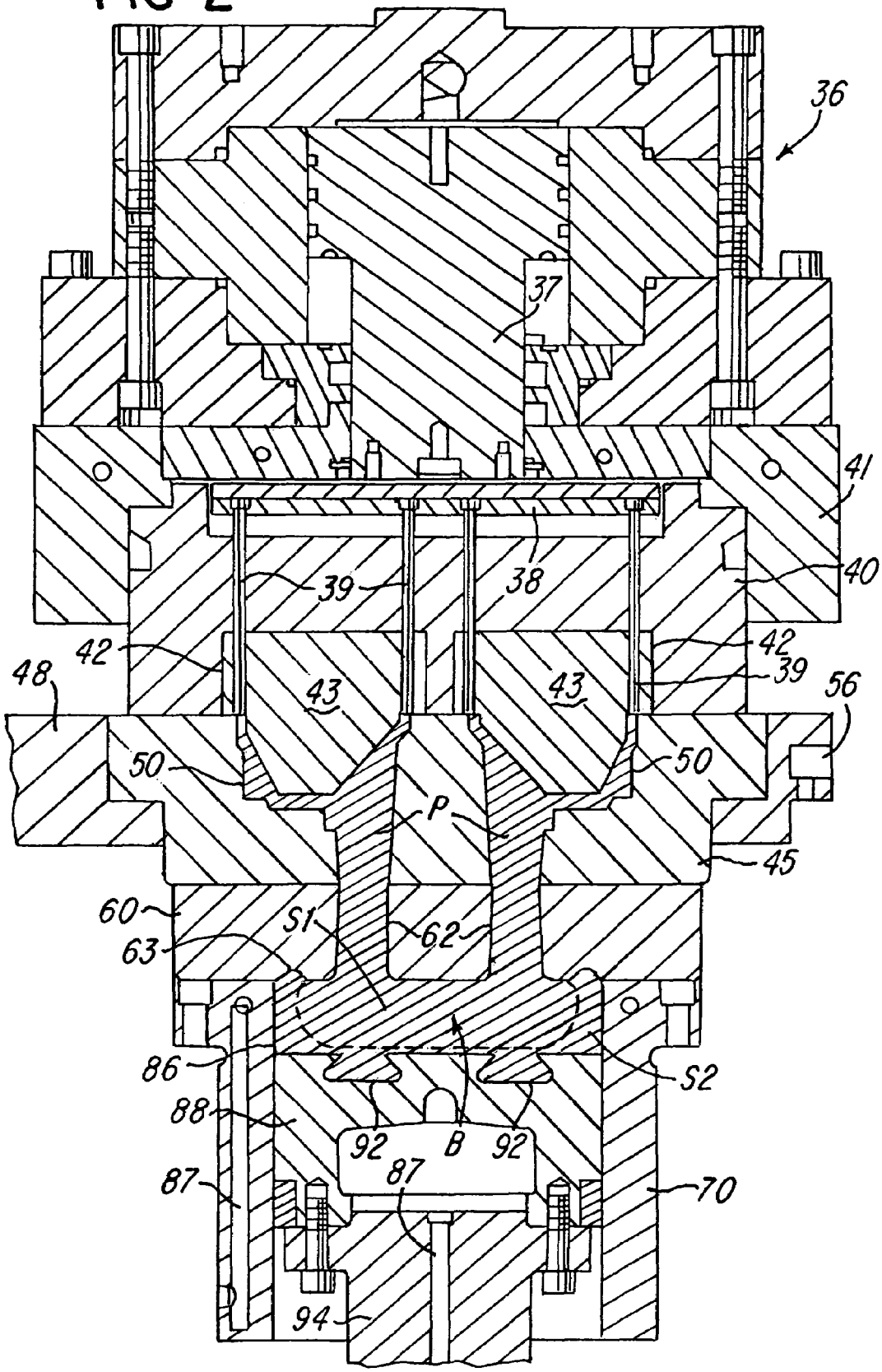
FIG. 2 is an enlarged fragmentary section of the semi-solid slurry transfer or injection position or station shown in FIG. 1 and with the die set shown in its closed position.

An upper die or mold section 40 (FIG. 2) is secured to the bottom of the plate 38 by an annular retaining plate 41 and has a pair of recesses 42 which receive corresponding core members 43. A lower die or mold section 45 is recessed within a circular indexing or transfer table 48 and defines a pair of cavities 50 which cooperate with the core members 43 to define the corresponding metal parts P produced in accordance with the method of the invention. The transfer or indexing table 48 is mounted on a shaft 52 (FIG. 1) supported by a set of bearings 53 retained within the frame member 54. The table 48 carries a plurality of at least two lower mold sections 45 and is rotated or indexed by a pinion (not shown) engaging periphery teeth 56 on the table 48 and driven by a stepping motor (not shown). A gate plate 60 is positioned under the bottom mold section 45 and defines a pair of slightly tapered gates or sprue openings 62, one for each of the cavities 50. The gate plate 60 also defines an annular metal entrapment recess or groove 63. It is to be understood that the parts P to be die cast within the corresponding mold sections 40 and 45 are shown for illustration only and that the configuration or size of the parts form no part of the present invention. The parts P may be any size or shape, corresponding to the desired die cast article.

A cylindrical vertical column or post 66 is secured to a plate 67 mounted on the base plate 18 and projects upwardly to support a rotatable circular table 68 by a set of anti-friction bearings 69 mounted on a top hub of the post 66. The table 68 supports a plurality or a pair of diametrically opposite cylindrical shot sleeves 70 which have parallel vertical axes. The table 68 is also supported by a set of thrust bearings 72 mounted on the cross bars or plates 22 and 24. The table 68 also has peripheral gear teeth 74 which engage a pinion (not shown) mounted on a vertical shaft of an electric stepping motor (not shown). Actuation of the stepping motor is effective to index the table 68 in steps or increments of 180° for alternately presenting the pair of shot sleeves 70 between a molten metal receiving or pour station 80 and a metal injecting or transfer station 82 located under the die sections 40 and 45 and in axial alignment with the clamping cylinder 30.

Each of the shot sleeves 70 defines a cylindrical shot chamber 86 which receives a corresponding shot piston 88. The upper end portion of each shot piston 88 has a pair of laterally extending and tapered dovetail slots 92, and a shot piston rod 94 projects downwardly from each piston 88. Each of the shot sleeves 70 and each of the piston rods 94 is provided with internal passages 87 (FIG. 2) by which cooling fluid or water is circulated through the sleeves and pistons 88 for cooling the molten metal and to form a metal residue biscuit B having integrally connected and upwardly projecting gate pins formed by the gate openings 62.

A double acting hydraulic shot cylinder 95 is mounted on a spacer plate 96 secured to the base plate 18 under the metal transfer station 82 and in vertical alignment from the axis of the hydraulic clamping cylinder 30. The shot cylinder 95 includes a piston and piston rod 98 which projects upwardly, and a guide plate 99 is secured to the upper end of the piston rod 98. Another double acting hydraulic ejection cylinder 110 is substantially smaller than the cylinder 95 and is mounted on the plate 67 by a spacer block 112. The cylinder 110 includes a piston and piston rod 114 and a guide plate 116 is secured to the upper end of the piston rod 114. A guide rod 118 projects downwardly from the plate 116 and through a guide block 121 mounted on the cylinder 110 to prevent rotation of the plate 116 and piston rod 114. The cylinder 110 is located in vertical axial alignment with each shot sleeve 70 when the sleeve is located at the metal receiving or pouring station 80.

A pair of opposing retaining or coupling plates 126 are secured to the upper surface of each of the guide plates 99 and 116. Each set of coupling plates defines inner and outer opposing undercut slots for slidably receiving an outwardly projecting circular flange 128 formed on the bottom of each shot piston rod 94. Thus when the table 68 and shot sleeves 70 are indexed in steps of 180°, the shot piston rods 94 are alternately connected or coupled to the piston rods 98 and 114.

In operation of the vertical die cast machine or press 10 to perform a semi-solid molding method, a commercially available permanently grain refined alloy such as SiBloy foundry ingot produced by Elkem Aluminum AS, or a non-permanently grain refined alloy such as standard A356 aluminum foundry ingot or foundry alloy ingot of the Al—Si, Al—Cu, Al—Mg or Al—Zn families, is heated to a molten state. Preferably, when a melt of non-permanently grain refined alloy is at a predetermined temperature, for example 650° C. or higher, an $\alpha$ aluminum grain refining material, for example, a titanium boron master alloy sold under the trademark TiBloy and produced by Metallurg, is added at a preferred melt-to-master alloy ratio according to the manufacturer's recommendations. The grain refinement step is not necessary when utilizing a permanently grain refined alloy such as SiBloy. After the molten grain refined alloy is lowered to a temperature of about 626° C., or within the range of 621° C. to 632° C., the molten alloy is poured into the vertical shot chamber 86 located at the pour or fill station 80 above the ejection cylinder 110. Preferably, the shot chamber 86 has a diameter substantially larger than its depth or axial length, for example, a diameter over 6 inches, such as 7½ inches and a depth of less than 6 inches.

Figure 3:
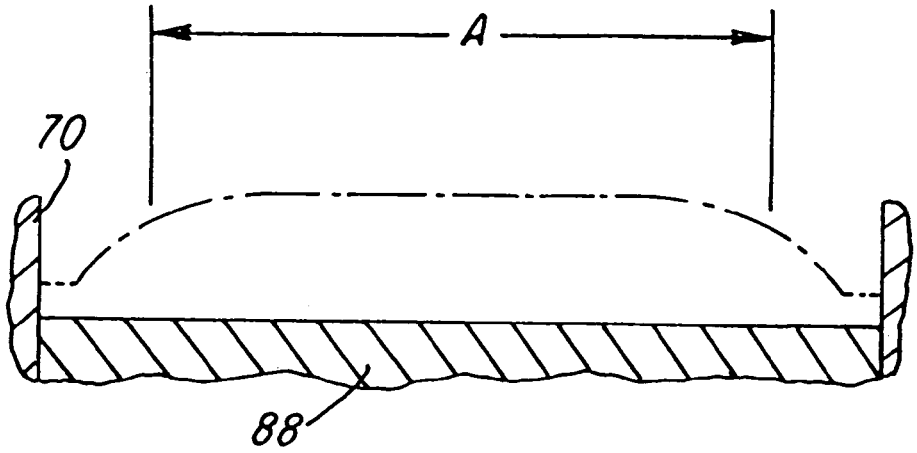
FIG. 3 is a diagrammatic illustration of the metal temperature profile of the semi-solid slurry before a central portion of the slurry is transferred or injected into the die cavities shown in FIG. 2.

The shot sleeve 70 confining the molten alloy is then indexed to the transfer or injection station 82 while a cooling period occurs. The molten alloy is allowed to cool in the shot chamber 86 to a temperature range that produces a semi-solid slurry having a range of 40% to 60% solid, such as approximately 50% solid and a globular generally non-dendritic micro structure. For example, the A356 aluminum alloy is allowed to cool to a temperature range between 570° C. and 590° C. for a period of fifteen seconds or more from the time it entered that temperature range to the shot or injection time. When the alloy has cooled to this temperature within the shot chamber 86 at the transfer station 82, the temperature profile of the alloy is close to that shown in FIG. 3 wherein a central portion A of the alloy has a substantially uniform temperature, and the peripheral portion of the alloy adjacent the shot sleeve 70 is significantly cooler due to the cooling effect of the shot sleeve.

With the mold sections 40 and 45 in their closed position (FIG. 2) by actuation of the cylinder 30, the injection or shot cylinder 95 is actuated to move the shot piston 88 upwardly. This transfers the semi-solid slurry S1 within the central portion A (FIG. 3) of the alloy upwardly through the gate or sprue openings 62 and into the corresponding die cavities 50 to form the parts P which have the desired globular, generally non-dendritic micro structure. The more solidified outer portion of the slurry S2 within the shot chamber adjacent the sleeve 70 is captured or trapped in the annular recess 63 and prevented from entering the sprue openings 62.

While the parts P are solidifying within the cavities 50, another charge of molten alloy is poured into the second shot chamber 86 located at the pour station 80. When the parts in the cavities 50 are solidified, the shot cylinder 95 is actuated to retract the piston 88 and the residual solidified alloy material or biscuit B within the shot chamber 86 and to shear the metal within the gate or sprue openings 62 from the parts P at the interface of the lower mold section 45 and the gate plate 60. The residual solidified metal or biscuit B, including the sprees, within the shot chamber 86 is then transferred by indexing the table 68 to either a biscuit removal station or to the metal pour station 80. At this station, the piston 88 is elevated to a level where the biscuit B is ejected laterally by a fluid cylinder (not shown). After the parts P are fully solidified, the upper mold section 40 is retracted upwardly by actuation of the cylinder 30 while the cylinder 36 is actuated to eject or release the parts with the pins 39. The table 48 is then indexed to transfer the parts P to a part removal station where the parts are lifted and removed, for example, by a robot (not shown). The above method steps for semi-solid molding are then repeated for successively molding another set of parts.

Figure 4:
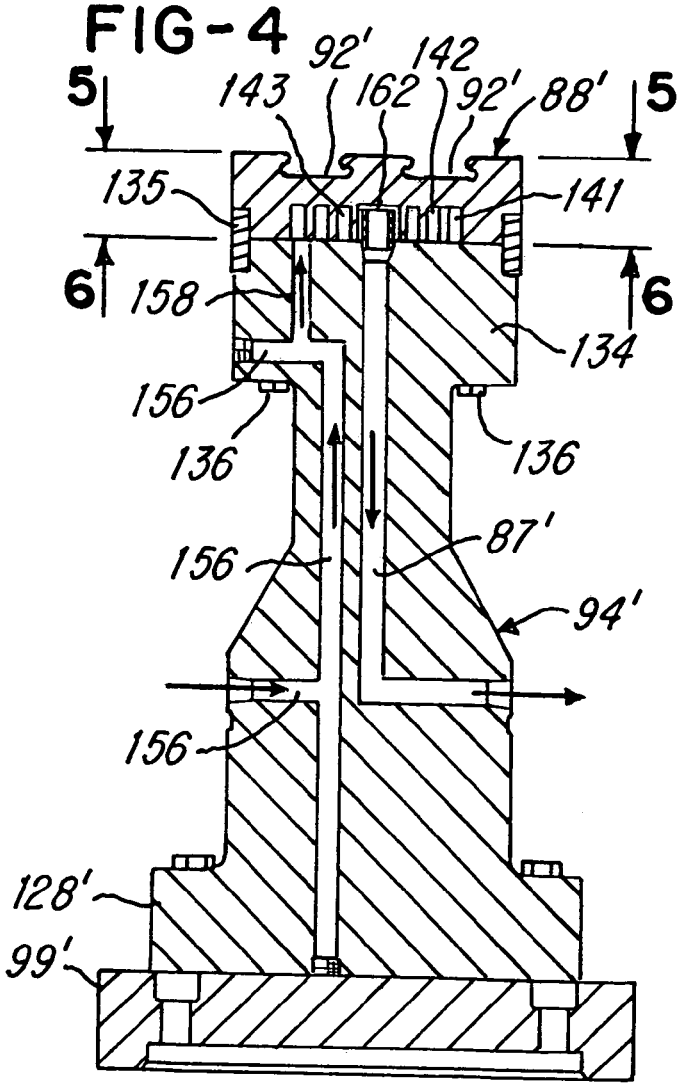
FIG. 4 is an axial section of a shot piston similar to the shot piston shown in FIG. 1 and showing a modification of the invention.
Figure 5:
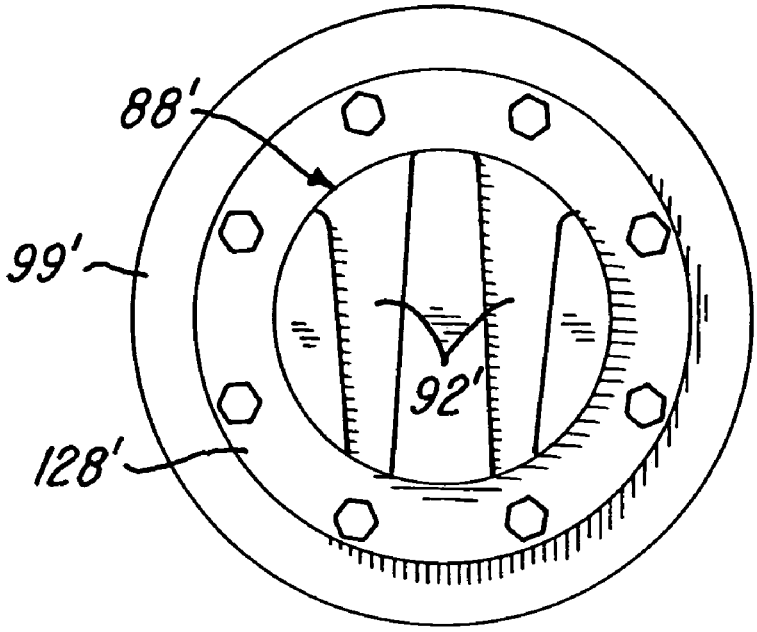
FIG. 5 is a top view of the shot piston, taken generally on the line 5-5 of FIG. 4.
Figure 6:
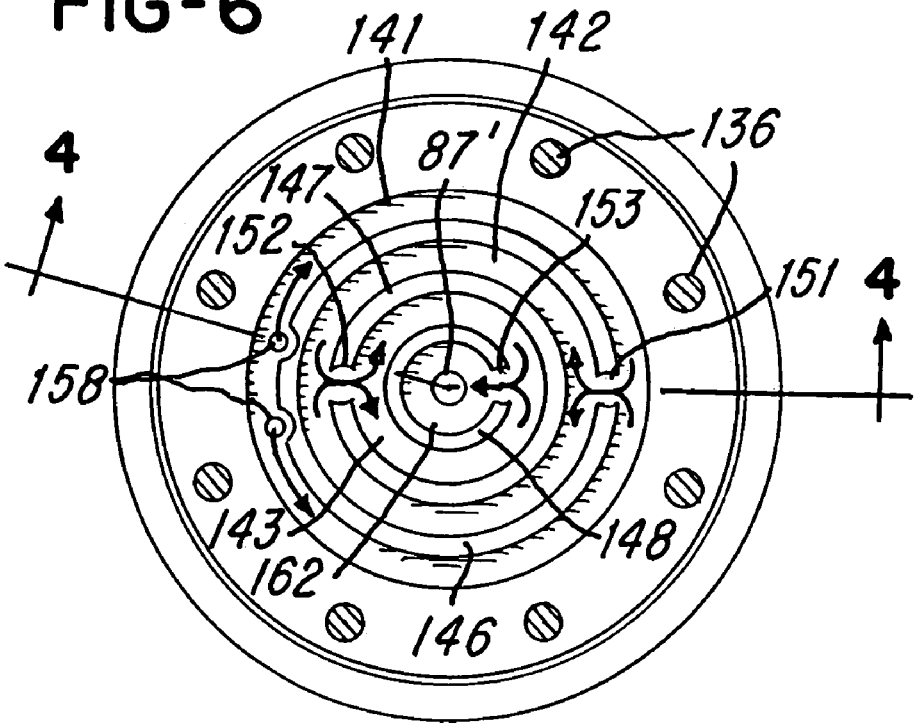
FIG. 6 is an enlarged bottom view of the shot piston, taken generally on the line 6-6 of FIG. 4.

FIGS. 4-6 illustrate a modification of a shot piston and shot piston rod constructed and assembled in accordance with another embodiment of the invention and in which components corresponding to the components described above in connection with FIGS. 1 and 2 are identified with the same reference numbers but with the addition of prime marks. Thus as shown in FIGS. 4-6, a cylindrical shot piston 88' has an upper surface with a set of tapered dovetail slots or recesses 92' and is secured to a mating upper head portion 134 of a shot piston rod 94' by a locating band 135 and a series of axially extending and circumferentially spaced bolts 136 (FIGS. 4 and 6). The cylindrical shot piston 88' has a bottom surface with a set of concentric passages or grooves 141, 142 and 143 defined between concentrically spaced walls part-cylindrical 146, 147 and 148. The grooves are successively interconnected by passages or ports 151, 152 and 153 formed within the walls 146, 147 and 148, respectively. As shown in FIG. 6, the ports 151 and 153 are diametrically opposite the port 152 to provide a maze path for cooling fluid or water, as shown by the arrows in FIG. 6.

Referring to FIG. 4, a pair or set of cooling fluid or water inlet passages 156 are formed within the shot piston rod 94' and are connected by a pair of corresponding axially extending passages 158 to the outer circular passage or groove 141 within the shot piston 88'. The shot piston rod 84' also has a cooling fluid or water outlet passage 87' which extends within the center of the shot piston rod 94' to a center chamber 162 (FIG. 6) within the shot piston 88' and defined within the part-cylindrical wall 148. As shown in FIGS. 4 and 6, the cooling fluid or water flows upwardly through the passages 156 and 158 within the shot piston rod 94' and successively inwardly through the grooves 141, 142 and 143 along the maze path and into the center chamber 162 where the hotter cooling fluid or water is removed from the shot piston 88' and shot piston rod 94' through the passage 87'.

From the drawings and the above description, it is apparent that a method of semi-solid molding of parts with a vertical die casting press in accordance with the present invention, provides desirable features and advantages. For example, the method of the invention provides for producing die cast parts free of porosity and which may be heat treated to provide a reliable high level of strength and ductility. As a result, the parts may have thin wall sections and be lighter in weight and/or may be complex die cast parts having close tolerances. The method also extends the service life of the die sections since the die sections receive less sensible heat because the injected slurry is at a lower temperature than fully molten metal and with less heat of fusion since the slurry is already approximately 50 percent solid when injected. Also, since the die is required to absorb much less heat in the process, the overall cycle time may be decreased to obtain more efficient production of parts.

The semi-solid molding method of the invention also eliminates the preparation of special billets or special slurries and the substantial cost of the preparation equipment, and enables the reuse of process offal and scrap. That is, by using conventional foundry ingots or ingots of pure metal, which may be grain refined, the method of the invention significantly lowers the cost of input material for semi-solid molding. As another feature, the large diameter to depth ratio of the shot chamber and the controlled cooling of the shot sleeves and shot piston provide for obtaining the desired cooling and temperature profile of the alloy within the semi-solid slurry S1 in the center portion of the shot chamber. The annular entrapment recess 63 is also effective to prevent the more solidified alloy S2 adjacent the shot chamber wall or sleeve from entering the sprue openings 62 and flowing into the cavities 50. The short stroke of the shot piston 88, which is greater than its diameter, also provides for a broad range of cavity fill rates, for example, when a rapid fill rate is desired for parts having thin wall sections or a slow fill rate is desired for parts having heavy wall sections. The diameter of the shot sleeve and piston are preferably over 6" and may be substantially more, for example, 24" in order to die cast a large diameter SSM part such as a motor vehicle wheel or frame member.

The construction of the shot piston 88' and shot piston rod 94' also provides desirable features. That is, the large area for heat transfer as provided by the walls 146, 147 and 148 and the maze path for the cooling fluid or water within the grooves between the walls provide for rapidly transferring heat from the molten metal or alloy within the shot chamber 86 to the cooling fluid and thereby provide for reducing the molding cycle time and/or temperature uniformity in the molten metal or slurry. The ribs or walls 146-148 within the shot piston also strengthen the piston against deflection due to injection pressure, which is especially desirable for large diameter or area pistons.

While the method and forms of apparatus herein described constitutes preferred embodiments of the invention, it is to be understood that the invention is not limited to the precise method and forms of apparatus described, and that changes may be made therein without departing from the scope and spirit of the invention as defined in the appended claims. For example, while the vertical die cast press 10 incorporates rotary indexing tables 48 and 68, vertical die cast presses with other forms of transfer means may be used, for example, a reciprocating shuttle table for the bottom die section or a tilting mechanism for a single shot sleeve.

What is claimed is:

1. A method of producing a high strength metal part within a die cavity defined by a die set mounted on a vertical die cast press, the press including a shot sleeve having cooling passages and a generally vertical axis and with the shot sleeve enclosing a shot piston having cooling passages and movable axially within the sleeve, and with the sleeve and piston defining a shot chamber above the piston, the method comprising the steps of:

melting a solid metal to form a liquified molten metal, pouring the molten metal directly into the shot chamber, confining the molten metal within the shot chamber to have a horizontal width substantially greater than the vertical depth of the molten metal within the shot chamber, cooling the shot sleeve and the shot piston to cool the molten metal within the shot chamber to within a predetermined temperature range while the molten metal within the shot chamber has a horizontal width substantially greater than the vertical depth, solidifying a portion of the molten metal in the shot chamber to form a semi-solid slurry having at least 40% of solids and a globular and generally non-dendritic microstructure, moving the shot piston upwardly within the shot chamber to inject the semi-solid slurry from the shot chamber into the die cavity through at least one gate opening, and allowing the semi-solid slurry to solidify within the die cavity to form the metal part.

2. A method as defined in claim 1 wherein the molten metal is cooled within the shot chamber into the semi-solid slurry while the molten metal within the shot chamber has a horizontal width at least twice the vertical depth of the molten metal.

3. A method as defined in claim 1 wherein the molten metal is cooled within the shot chamber to form a semi-solid slurry having a range of 40% to 60% solids.

4. A method as defined in claim 1 and including the steps of:

forming a downwardly facing annular entrapment recess above the shot chamber and generally in vertical alignment with and opposing an inner surface of the shot sleeve, and collapsing and crushing in a generally vertical direction a more solidified outer portion of the semi-solid slurry adjacent the shot sleeve into the entrapment recess in response to upward movement of the shot piston to avoid flow of the more solidified outer portion of the slurry into the gate opening.

5. A method as defined in claim 1 wherein the molten metal is A356 aluminum alloy and is cooled within the shot chamber to a temperature within the range of 570° C. to 590° C. to form the semi-solid slurry.

6. A method as defined in claim 1 and including the steps of:

pouring the liquified molten metal directly into a second said shot chamber defined by a second said slot sleeve receiving a second said shot piston, confining the molten metal in said second shot chamber to have a horizontal width substantially greater than its vertical depth, interchanging said second shot sleeve and piston with said first shot sleeve and piston after the semi-solid slurry is injected from said first shot chamber into the die cavity, and cooling the molten metal within said second shot chamber with said second shot sleeve and said second shot piston to form a semi-solid slurry having at least 40% solids while the molten metal and slurry within said second shot chamber has a horizontal width substantially greater than its vertical depth.

* * * * *